US006449217B1

(12) United States Patent
Hayet et al.

(10) Patent No.: US 6,449,217 B1
(45) Date of Patent: Sep. 10, 2002

(54) LOW COST CLOCK

(75) Inventors: Pascal Hayet, Rambouillet; Alain Sauve, Nogent le Phaye, both of (FR)

(73) Assignee: Siemens AG (DE)

( * ) Notice: Subject to any disclaimer, the term of this patent is extended or adjusted under 35 U.S.C. 154(b) by 0 days.

(21) Appl. No.: 09/401,421

(22) Filed: Sep. 22, 1999

(30) Foreign Application Priority Data

Sep. 22, 1998 (EP) ..... 98402328

(51) Int. Cl.[7] ..... G04F 5/00
(52) U.S. Cl. ..... 368/10; 368/200
(58) Field of Search ..... 368/156, 200, 368/203, 48, 10

(56) References Cited

U.S. PATENT DOCUMENTS 3,911,373 A 10/1975 Ohtake et al.
4,179,876 A * 12/1979 Moriyama ..... 368/10
4,264,967 A * 4/1981 Fujita et al. ..... 368/156
4,427,302 A * 1/1984 Watanabe ..... 368/200
5,412,624 A * 5/1995 Yocom ..... 368/156
5,999,493 A * 12/1999 Olson ..... 368/47

* cited by examiner

*Primary Examiner*—Bernard Roskoski
(74) *Attorney, Agent, or Firm*—Mayer, Brown, Row & Maw

(57) ABSTRACT

A time display is comprised of a low cost low accuracy RC oscillator. A series of pulses derived from this oscillator, for example, with a period of 1 second, is used for controlling a diode. An accurate time-display function of a car radio is also derived from this oscillator. This is possible as the main micro-controller periodically calibrates the low accuracy oscillator using a high accuracy crystal clock. Specifically, it measures the PC oscillator period in order to correct, in the micro-controller, the time issued from the RC oscillator.

1 Claim, 2 Drawing Sheets

LOW COST CLOCK

BACKGROUND OF THE INVENTION

1. Field of the Invention

The present invention relates to the field of timing devices. Specifically, the present invention is directed to a device for displaying the time on basis of a clock. The basic pulse generator for the clock is a low accuracy oscillator that is continuously functioning and supplies pulses. The device is also equipped with a micro-controller having a high accuracy clock that is switched off when the device is switched off.

2. Description of the Related Art

A low accuracy oscillator is known from the U.S. Pat. No. 3,911,373. According to this reference, an oscillation control circuit comprises an astable multivibrator and a display means such as a light emitting diode which is connected to and controlled by the astable multivibrator. One object of the invention is to provide a low cost clock which has good precision. Other objects and advantages will be apparent from the following Summary and Detailed Description of the preferred embodiments.

SUMMARY OF THE INVENTION

In accordance with the present invention, the device is provided with a mechanism that is active at least when the device is switched off, for periodically starting the micro-controller. When the micro-controller is on, the mechanism calibrates the frequency of the low accuracy oscillator with help of the high accuracy clock. Additionally, the device including a means for using the result of the calibration in order to display a corrected time.

It is possible to implement a low cost time display function, for instance in a car radio, using a low cost oscillator, as far as the clock of the micro-controller is based on a crystal. The accuracy of the time display is roughly the accuracy of the crystal, i.e. the influence of other devices is negligible.

These and other more detailed aspects of the invention will be apparent from the following description of an exemplary embodiment of the invention.

DETAILED DESCRIPTION OF THE PREFERRED EMBODIMENTS

Figure 1:
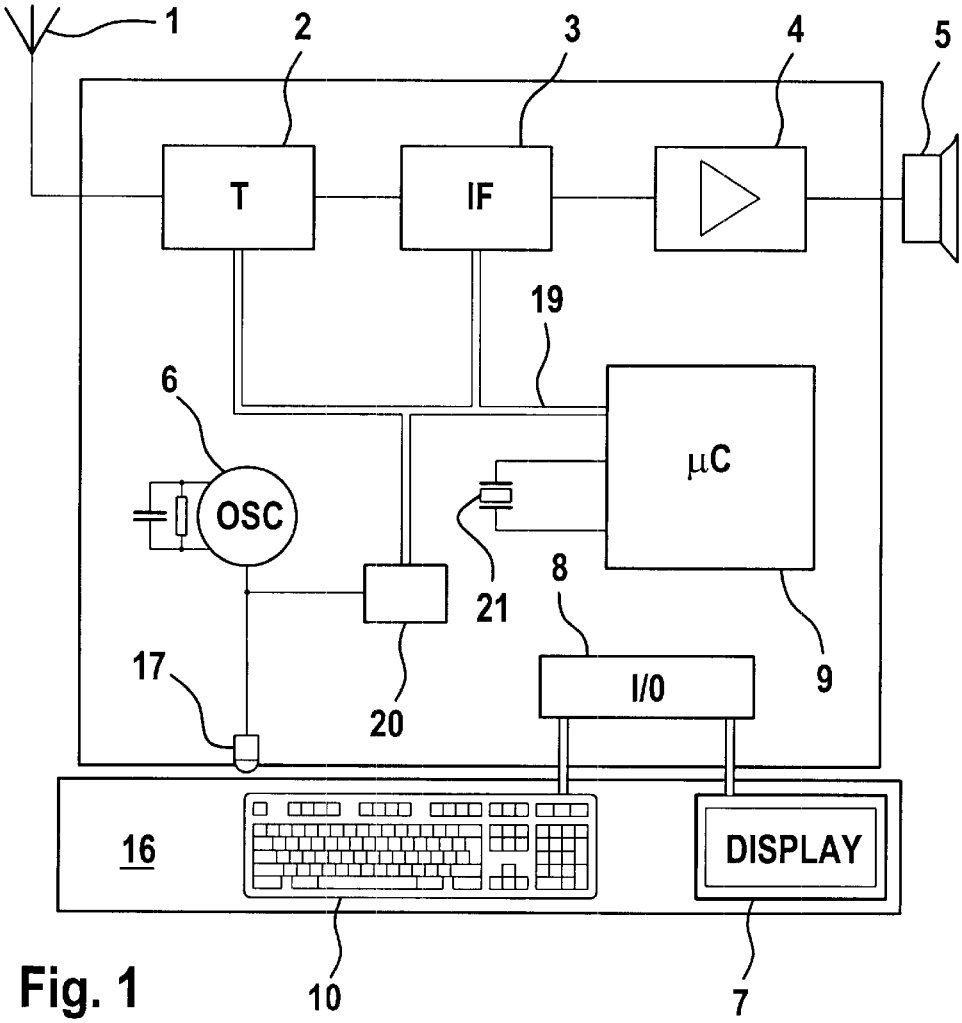
FIG. 1 diagrammatically represents a car radio.

The exemplary embodiment is directed to a car radio with a detachable front panel typically provided for anti-theft purpose. The car radio of FIG. 1 comprises an aerial 1, a tuner 2, followed by an intermediate frequency amplifier and demodulator 3. An audio amplifier 4 is connected to a loudspeaker 5. A micro-controller 9, that manages all the functions of the car radio is connected by a bus 19 to the above mentioned elements. The detachable front panel 16 comprises a keyboard 10 and a display screen 7.

When front panel is off, a blinking light emitting diode (LED) 17 is flashing. The pulses used for this blinking LED are generated by a low cost, low accuracy RC oscillator 6 based on a known circuit. For example, one specific embodiment may employ an integrated circuit of the type HEF4528. This oscillator directly controls the diode 17. An interface 20 provides a series of pulses to the bus 19 which are derived from the oscillator. The oscillator preferably has a period of 1 second.

A time display function of the car radio is also derived from this oscillator. This is possible if the main micro-controller 9 periodically calibrates the low accuracy oscillator using its own high accuracy crystal clock 21. For example, it measures the RC oscillator period in order to correct, in the micro-controller, the time issued from the RC oscillator.

Figure 2:
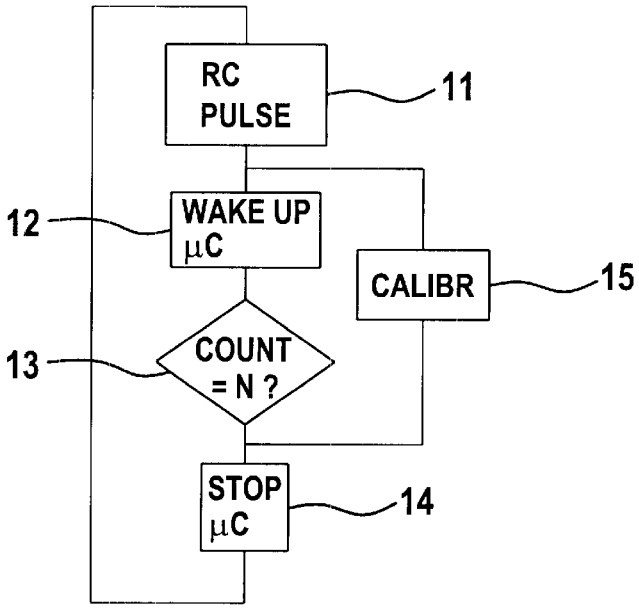
FIG. 2 is a flow diagram of a process for calibrating the oscillator.
Figure 5:
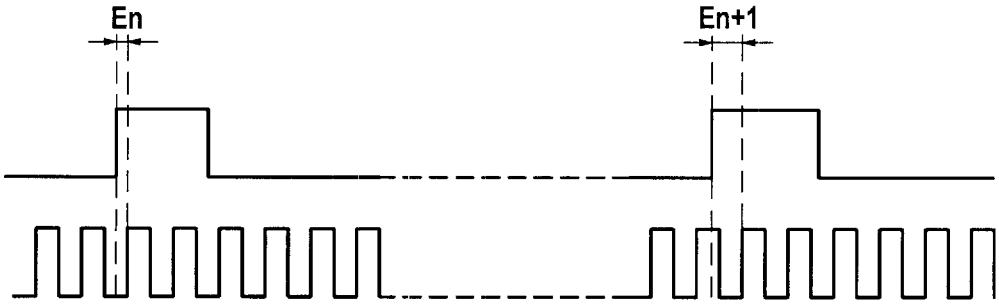
FIG. 5 is a time diagram showing how an error could occur during the calibration.

When the car radio is OFF, the process is illustrated by FIG. 2. In step 11, the oscillator sends a pulse to the micro-controller. In step 12, the micro-controller is waked-up during the time necessary for LED blinking plus incrementing a first counter. In step 13, if the first counter has reached a predetermined "n" value (Y), then the micro-controller calibrates the RC oscillator in step 15. If it has not (N), then the micro-controiler is stopped. For calibrating, the micro-controller simply starts a second internal counter (based on an accurate crystal oscillator) on the incoming pulse event and stops it on the following pulse event (FIG. 5). Then, the clock value is corrected by this last calibration for the period of time from the previous calibration onwards (or alternatively till the next calibration).

When the car radio is ON, depending of the software implementation, two algorithms may be used:

- in a first implementation, the same algorithm is used as when power is OFF, except that there is no need for waking up the micro-controller. It is preferred that, the blinking LED oscillator remain working when car radio is ON. The advantage of such a solution is that no further software is required.
- in a second implementation, the internal timer of the micro-controller is used.

The micro-controller generates a virtual "true" clock on basis of a "false" clock. An example showing how it works is given hereafter. First, suppose that the micro-controller makes a calibration every minute and that, at t0, it measures that one second of the "false" clock has the actual value 0.95 second. At t0+one "false" minute, it measures one "false" second 0.94 second. At t0+two "false" minutes, it measures one "false" second 0.93 second. These measurements are stored. Then it will display a true clock as follows: at t0+one "false" minute, it will display t0+0.95*60 sec=t0+57 sec; at t0+two "false" minutes, it will display t0+0.95*60 sec+0.94*60 sec=t0+113.4 seconds, etc. In the simplest embodiment, the clock is displayed only when the radio-set is switched ON but, when the radio is OFF, true time is saved every minute each time the micro-controller is waked up.

Several parameters should be taken into account when evaluating the accuracy of this low cost clock, notably the accuracy of the RC blinking LED oscillator used for 1 Hz pulse; the absolute value of the pulse rate has no importance here because it is calibrated later on in the process.

Figure 3:
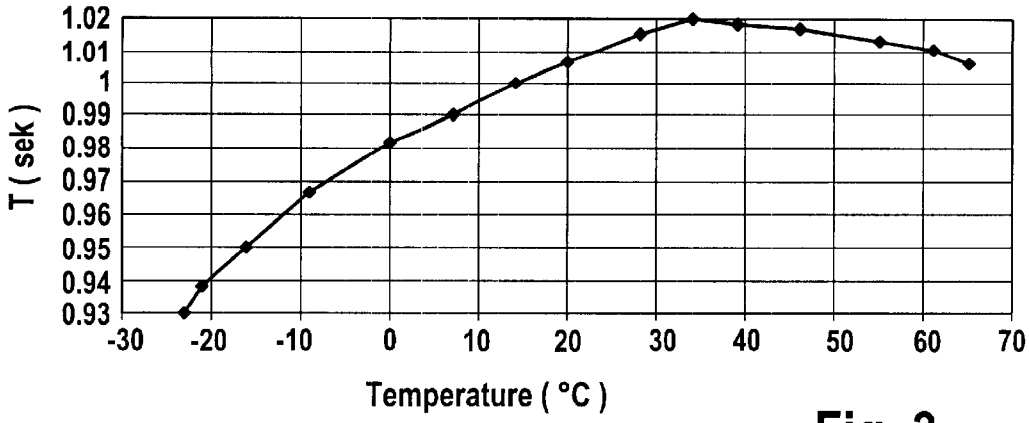
FIG. 3 is a diagram showing the variation of the frequency of the oscillator over temperature.
Figure 4:
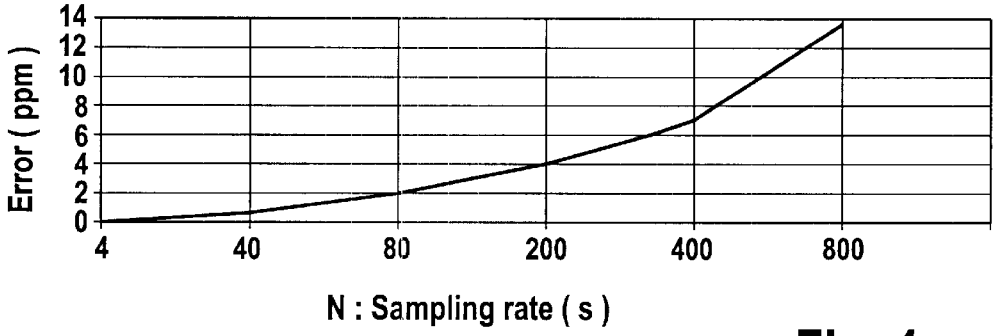
FIG. 4 is a graph showing the error made during the calibration, versus sampling rate.

In the diagram of FIG. 3, the relative value of the pulse rate is changing when temperature is changing inside the set. In order to cope with this inaccuracy, it is important to determine in a real environment, and for a long period of time, the behavior of the 1 Hz oscillator. This can be realized using a high performance counter that measures the oscillator period at regular intervals. Results are derived from these measurements. An example is summarized on the graph of FIG. 4. The sampling rate relates to the value of "n", i.e. roughly the time between calibrations. The estimated error is approximately a linear function of the sampling rate. As the micro-controller is ON during the calibration process, it is important, for minimizing quiescent current consumption, to maximize "n".

Taking n=60 (calibration each minute) is a good compromise. It increases the quiescent current consumption of the whole car radio by only 2%, compared with the consumption without calibration, while the error on the clock pulse estimation is then only 1 PPM (in an environment where temperature would be changing 10 times faster, the error would be only 10 PPM, i.e. still negligible).

The upper curve of FIG. 5 represents two successive blinking LED impulses. The lower curve represents the micro-controller clock pulses. The microcontroller counts the number of clock pulses between two successive impulses. The absolute error in the measurement of the pulse rate by the oscillator of the micro-controller is given by the difference between En and En+1. It is totally random, its mean value is half the micro-controller clock period and can be neglected when measuring the impulse period on a large number of samples. The micro-controller is provided with a register for memorizing the count between En and En+1, representing the number of pulses received from the oscillator.

Obviously, the software or firmware controlling implementation of such a clock will have to take care of additional considerations, such as, for example, power on/off, resets and other conditions where the clock function cannot be managed correctly by the micro-controller. Additionally, the power supply of the micro-controller must be regulated, to prevent a fall of the supply voltage when the micro-controller is started.

We claim:

1. A car radio with a clock comprising:

a low accuracy oscillator that supplies pulses;

a microcontroller having a high accuracy clock that is used to periodically calibrate the low accuracy oscillator, even when the car radio is in an off state; and a means for displaying a corrected time.

* * * * *